US005097399A

United States Patent [19]

Gammache

[11] Patent Number: 5,097,399

[45] Date of Patent: Mar. 17, 1992

[54] FLASHLIGHT WITH SWIVEL HEAD

[76] Inventor: Richard J. Gammache, 1564 Mission Rd., Lancaster, Pa. 17601

[21] Appl. No.: 729,650

[22] Filed: Jul. 15, 1991

Related U.S. Application Data

[62] Division of Ser. No. 565,506, Aug. 10, 1990, Pat. No. 5,043,854.

[51] Int. Cl.[5] ..... F21L 7/00

[52] U.S. Cl. ..... 362/197; 362/199; 362/205; 362/207

[58] Field of Search ..... 362/188, 197-205, 362/194, 196, 208, 207

[56] References Cited

U.S. PATENT DOCUMENTS

| | | | |
|---|---|---|---|
| 1,093,287 | 4/1914 | Neff | 362/194 |
| 1,832,563 | 11/1931 | Kuhn | 362/197 |
| 2,259,673 | 10/1941 | White | 362/197 |
| 2,312,670 | 3/1943 | Olds | 362/207 |
| 4,937,713 | 6/1990 | Holt et al. | 362/199 |

*Primary Examiner*—James C. Yeung

[57] ABSTRACT

A flashlight has a casing containing batteries and a head assembly mounted on the casing. The head assembly includes a swivel head arranged for rotational movement about a swivel axis which is disposed at an acute angle with respect to a longitudinal axis of the casing. The swivel head carries a bulb and is asymmetrical so that rotational movement of the swivel head causes the beam of light emitted by the bulb to be directed in different directions. In one embodiment of the flashlight, the bulb is moved to various angular positions relative to the casing as the swivel head is rotated. In another embodiment of the flashlight, the bulb remains in a fixed relationship with the casing but a reflector is moved to various angular positions when the swivel head is rotated. The flashight also includes a push button type of switch mechanism for illuminating and extinguishing the bulb.

7 Claims, 3 Drawing Sheets

FLASHLIGHT WITH SWIVEL HEAD

This is a division of application Ser. No. 07/565,506 filed Aug. 10, 1990, U.S. Pat. No. 5,043,854.

BACKGROUND OF THE INVENTION

This invention relates generally to flashlights and, in particular, to a flashlight having a switch mechanism that may be operated with one hand and a swivel head that may be moved to various angular and rotational positions.

U.S Pat. No 4,725,932 granted Feb. 16, 1988 to R. J. Gammache discloses a flashlight having a cylindrical casing with a head assembly rotatably mounted on one end of the casing. Rotation of the head assembly operates a switch mechanism for illuminating and extinguishing a bulb that is disposed in the casing. The rotatable head assembly is also used to focus the beam of light emitted by the bulb. In the flashlight shown in the above-mentioned Gammache patent, the operation of the switch mechanism requires the use of two hands. That is, a person must use one hand to hold the casing while the other hand is used to rotate the head assembly and thus operate the switch mechanism. Also, in this flashlight, the head assembly cannot be moved to different angular positions with respect to the casing.

SUMMARY OF THE INVENTION

An object of the present invention is to provide a flashlight having a switch mechanism that may be operated using one hand.

Another object of the present invention is to provide a flashlight having a swivel head that may be moved to various angular and rotational positions.

The present invention provides a flashlight comprising a casing containing at least one battery and a head assembly mounted on the casing. The head assembly includes a swivel head carrying a bulb for emitting a beam of light. This swivel head is arranged for rotational movement about a swivel axis which is disposed at an acute angle with respect to a longitudinal axis of the casing thereby directing the beam of light emitted by the bulb in different directions. The flashlight also comprises a switch mechanism for electrically connecting the battery and the bulb. The head assembly includes a base mounted on one end of the casing, and the swivel head is rotatably mounted on the base. The bulb has a bottom portion thereof disposed in a bore in the swivel head.

In one embodiment of the flashlight, the switch mechanism comprises a switch button slidably mounted in the base of the head assembly for movement between a first position where the bulb is illuminated and a second position where the bulb is extinguished. The switch mechanism also comprises a rotor contact attached to the swivel head, and a swingable member mounted in the casing. The swingable member has a stem which extends through an opening in the switch button. This stem is engaged with the rotor contact when the switch button is in the first position but is disengaged from the rotor contact when the switch button is in the second position. The rotor contact has a flange that is annular in shape and which is engaged with the stem of the swingable member when the switch button is in the first position. The rotor contact also has a tab which is engaged with an electrical terminal of the bulb.

DESCRIPTION OF THE PREFERRED EMBODIMENT

Figure 1:
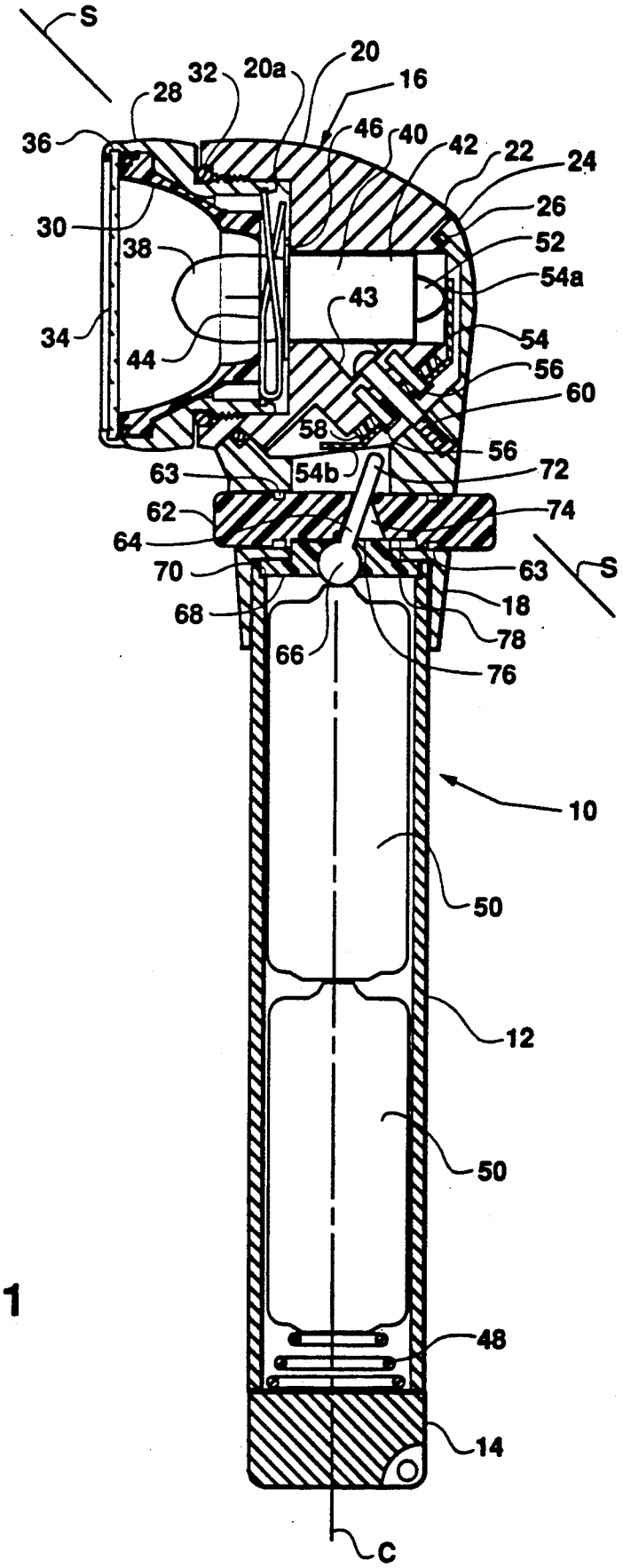
FIG. 1 is a longitudinal cross-sectional view of a flashlight according to one embodiment of the present invention, the flashlight having a swivel head carrying a bulb.
Figure 2:
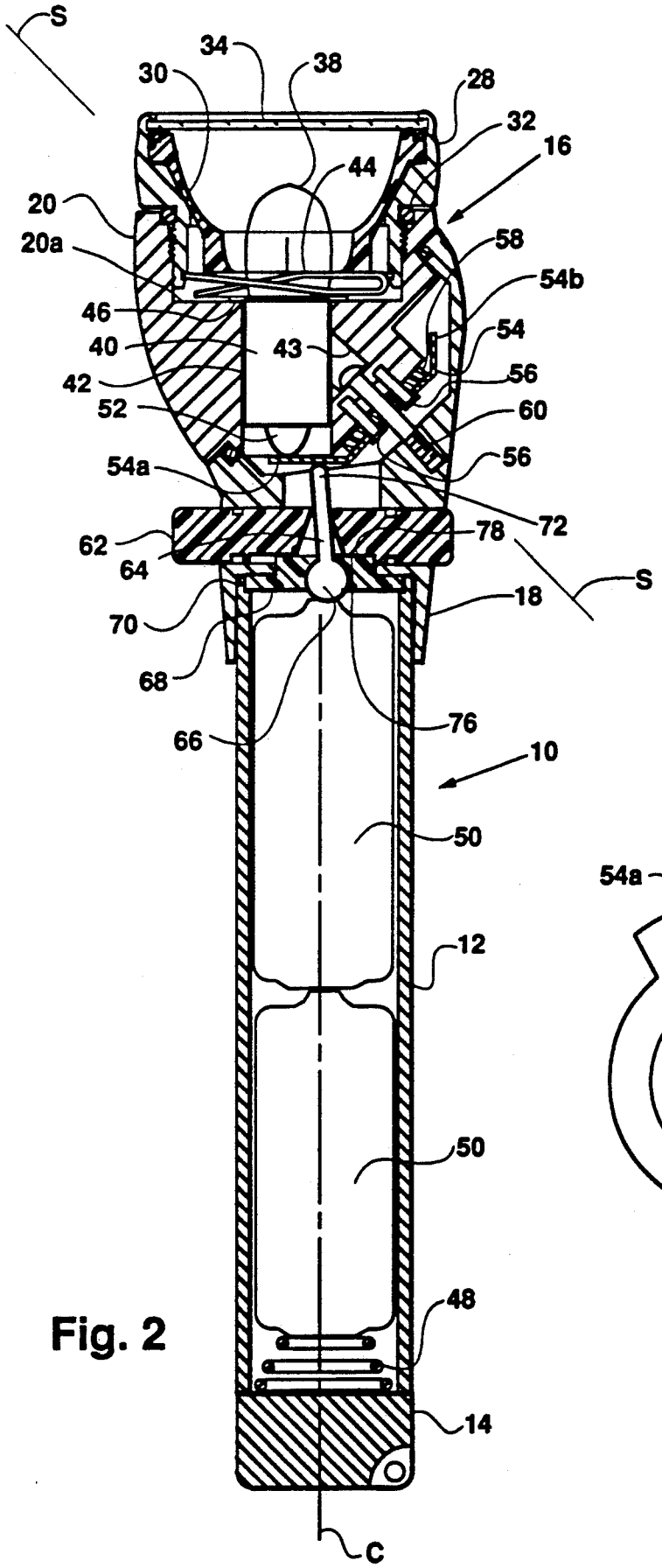
FIG. 2 is a longitudinal cross-sectional view of the flashlight shown in FIG. 1 with the swivel head rotated 180 degrees so that the bulb is moved through an arc of 90 degrees from a generally horizontal position to a generally vertical position.

Referring to FIGS. 1 and 2, a flashlight 10 includes a cylindrical metal casing 12, a metal tail cap 14 threaded onto the lower end of the casing 12, and a head assembly 16 mounted on the upper end of the casing 12. The head assembly 16 consists of a base 18 pressed onto casing 12 and a swivel head 20 rotatably mounted on the base 18 by engaging an annular groove 22 in the swivel head 20 with an annular flange 24 on the base 18. Swivel head 20 is arranged for rotational movement about a swivel axis S which is disposed at an acute angle of approximately 45 degrees with respect to longitudinal axis C of casing 12. The base 18 and the swivel head 20 are formed of conductive material such as a suitable metal, and a rubber O-ring 26 is disposed in the groove 24.

A lens cap 28 is threaded into the swivel head 20, and a reflector 30 is mounted in the lens cap 28. An O-ring 32 is provided between the lens cap 28 and the swivel head 20. A lens 34 is disposed in a groove 36 in the lens cap 28. The swivel head 20 carries a bulb 38 and has a bore 42 for receiving a bottom portion 40 of the bulb 38. When lens cap 28 is installed on swivel head 20, a spring washer 44 retained in lens cap 28 is compressed against an annular metal flange 46 on the bulb 38 thereby urging this flange 46 into contact with surface **20*a* of swivel head 20. Bulb 38 may be removed from flashlight 10 by unthreading the lens cap 28 from the swivel head 20**.

It will be understood that the flange 46 forms one electrical terminal for bulb 38 which is connected via swivel head 20, base 18, casing 12, tail cap 14, and a spring 48 to the negative terminal of one of a plurality of batteries 50 contained in the casing 12. Spring 48 is compressed between tail cap 14 and batteries 50 when flashlight 10 is assembled. Bulb 38 has another electrical terminal 52 which contacts tabs **54*a* on a rotor contact 54, preferably formed of beryllium copper. Tabs 54*a* may be deflected to accommodate bulbs of varying lengths. This rotor contact 54 is attached to the swivel head 20 by a pair of plastic rivets 56 which extend through holes 57 in the rotor contact 54. A pad 58 formed of nonconductive material insulates the rotor contact 54 from the swivel head 20. The swivel head 20 is fastened to base 18 by a bolt 60 which extends through a hole 61 in rotor contact 54. Since swivel axis S coincides with the longitudinal axis of bolt 60, swivel head 20 actually rotates about bolt 60. A bore 43 in swivel head 20 permits access to bolt 60**.

A switch button 62, preferably formed of nylon, is slidably mounted in base 18 of head assembly 16 for moving a swingable member 64 into and out of engagement with rotor contact 54. O-rings 63 are provided on the switch button 62. When the 62 is in an "on" position shown in FIG. 2, swingable member 64 is engaged with rotor contact 54 and an electrical circuit connecting the batteries 50 and the bulb 38 is closed thereby illuminating the bulb 38. With the bulb 38 illuminated, rotational movement of the lens cap 28 relative to the swivel head 20 causes reflector 30 to focus the beam of light emitted by the bulb 38 from a wide angle beam to a narrow beam. This rotational movement of lens cap 28 increases or decreases the compression in spring washer 44 but the bulb flange 46 is retained in contact with the swivel head surface 20*a*. Conversely, when the switch button 62 is in an "off" position shown in FIG. 1, swingable member 64 is disengaged from rotor contact 54 and the electrical circuit connecting the batteries 50 and the bulb 38 is opened thereby extinguishing the bulb 38.

The swingable member 64 has a ball 66 at one end which is pivotally retained in a plate 68 formed of plastic. Plate 68 is disposed in an annular groove 70 formed in the upper end of the casing 12. Swingable member 64 also includes a stem 72 which is swung back and forth for engagement and disengagement with a flange 54*b* on rotor contact 54. Stem 72 extends through an opening 74 in the switch button 62. A shoulder 76 on the plate 68 is received in a recess 78 in switch button 62 to limit the sliding movement of the switch button 62. Rotor contact 54, switch button 62, and swingable member 64 constitute a "switch mechanism" for electrically connecting the batteries 50 and the bulb 38.

When swivel head 20 is rotated relative to base 18 about axis S, reflector 30 and bulb 38 are moved to different positions with respect to the casing 12 in order to direct the beam of light from bulb 38 in different directions. For example, in FIG. 1, swivel head 20 is rotated so that reflector 30 and bulb 38 are in a generally horizontal position. However, when swivel head 20 is rotated 180 degrees about axis S as shown in FIG. 2, reflector 30 and bulb 38 will be moved through an arc of 180 degrees to a generally vertical position. This movement of reflector 30 and bulb 38 is due to the unique shape of the swivel head 20 which is asymmetrical with respect to a horizontal transverse plane extending through the swivel head 20 in FIG. 1.

Figure 3:
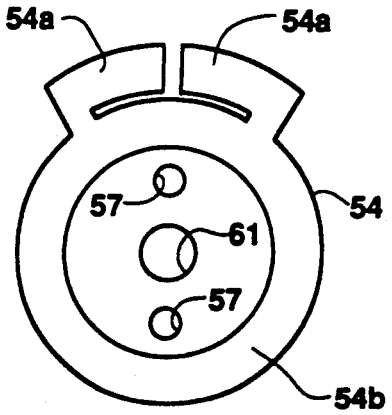
FIG. 3 is a plan view of one of the parts of the flashlight shown in FIGS. 1 and 2.

Since flange 54*b* on rotor contact 54 is annular in shape as shown in FIG. 3, it remains in engagement with the stem 72 of swingable member 64 during rotational movement of swivel head 20 if the switch button 62 is in its "on" position. On the other hand, the rotor contact flange 54*b* remains disengaged from the stem 72 of swingable member 64 during rotational movement of swivel head 20 if the switch button 62 is in its "off" position.

In an alternative embodiment of flashlight 10 (not shown), swivel head 20 is formed of nonconductive material and has a conductive wire extending therethrough contacting bulb flange 46 and base 18.

Figure 4:
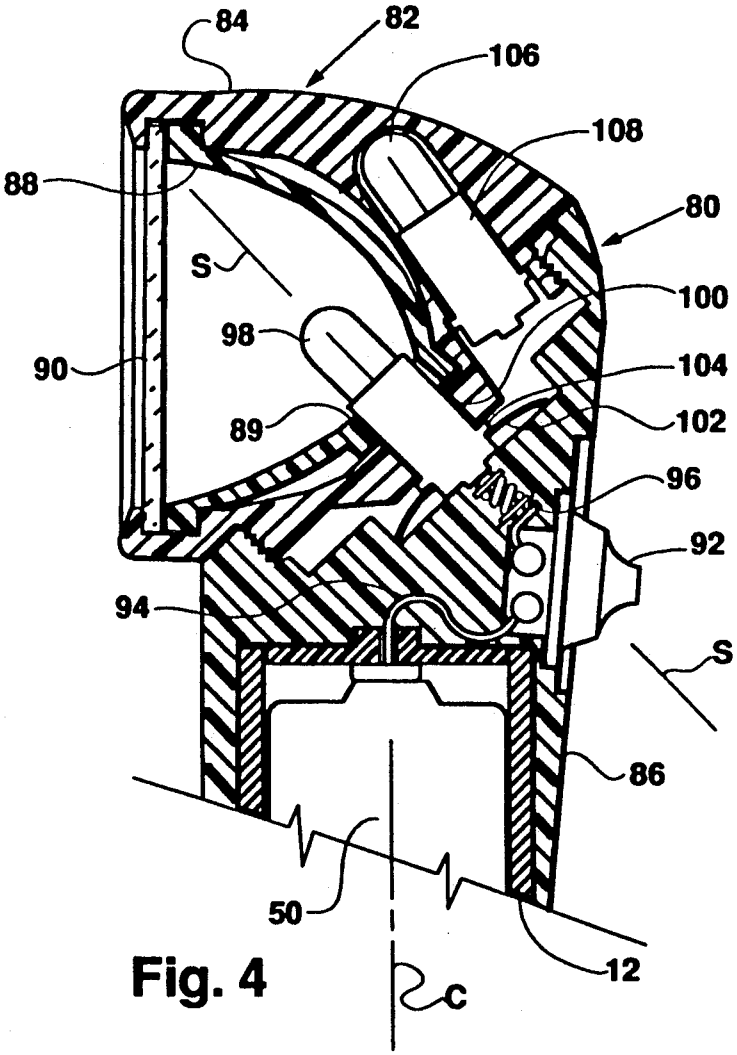
FIGS. 4 and 5 are longitudinal cross-sectional views of a flashlight according to another embodiment of the present invention.
Figure 5:
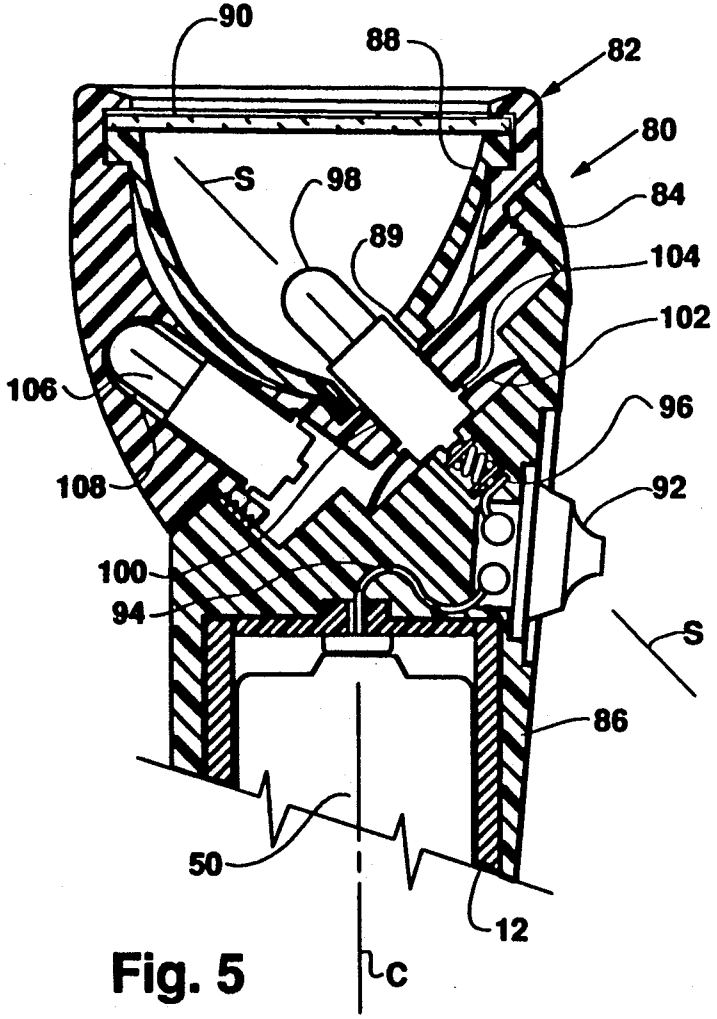

Referring to FIGS. 4 and 5, a flashlight 80 includes casing 12 containing batteries 50, tail cap 14, and a head assembly 82 which consists of a swivel head 84 threaded onto a base 86 for rotational movement about a swivel axis S. The swivel head 84 has a reflector 88 and a lens 90. A switch mechanism 92 and leads 94, 96 electrically connect the batteries 50 to one terminal of a bulb 98 that is carried in a bore 100 in the swivel head 84. Bulb 98 extends through an angled hole 89 in the reflector 88. A spring washer 102 is compressed between base 86 and a flange 104 on bulb 98 thereby urging the bulb flange 104 against the swivel head 84. Flange 104 forms another terminal for bulb 98 which is electrically connected via spring washer 102, base 86, casing 12, tail cap 14 and spring 48 to the batteries 50. Bulb 98 may be removed from flashlight 80 by unthreading the swivel head 84 from the base 86. A spare bulb 106 is carried in a pocket 108 in the swivel head 84.

As the swivel head 84 is rotated relative to base 86 about axis S, the bulb 98 remains in a fixed angular relationship with the casing 12 but the reflector 88 is moved to different positions and thus directs the beam of light emitted by bulb 98 in different directions. For example, in FIG. 4, the swivel head 84 is rotated so that the reflector 88 is in a generally horizontal position while, in FIG. 5, the swivel head 84 is rotated 180 degrees from FIG. 4 so that the reflector 88 is in a generally vertical position.

What is claimed is:

1. A flashlight comprising:

a casing containing a battery, said casing having a longitudinal axis;

a head assembly mounted on said casing, said head assembly including a swivel head and a bulb for emitting a beam of light, said swivel head being arranged for rotational movement about a swivel axis which is disposed at an acute angle with respect to said longitudinal axis thereby directing the beam of light emitted by said bulb in different directions; and said bulb having a portion thereof slidably disposed in a bore in said swivel head, said bulb being disposed in a fixed angular relationship with respect to said longitudinal axis of said casing as said swivel head is rotated about said swivel axis.

2. The flashlight of claim 1, further comprising a switch mechanism for electrically connecting said battery and said bulb.

3. The flashlight of claim 2, wherein said head assembly comprises a base mounted on one end of said casing, and wherein said swivel head is rotatably mounted on said base.

4. The flashlight of claim 3, further comprising a tail cap attached to the other end of said casing, and a spring disposed between said tail cap and said battery for urging said battery toward said head assembly.

5. A flashlight comprising:

a casing containing a battery, said casing having a longitudinal axis;

a head assembly mounted on said casing, said head assembly including a swivel head a bulb for emitting a beam of light, said swivel head being arranged for rotational movement about a swivel axis which is disposed at an acute angle with respect to said longitudinal axis thereby directing the beam of light emitted by said bulb in different directions;

said bulb being disposed in a fixed angular relationship with respect to said longitudinal axis of said casing as said swivel head is rotated about said swivel axis; and a reflector mounted in said swivel head, and wherein said bulb extends through a hole in said reflector, said hole being angled with respect to said longitudinal axis of said casing.

6. The flashlight of claim 5, further comprising spring means urging said bulb into said hole.

7. A flashlight comprising:

a casing containing a battery, said casing having a longitudinal axis;

a head assembly mounted on said casing, said head assembly including a swivel head and a bulb for emitting a beam of light, said swivel head being arranged for rotational movement about a swivel axis which is disposed at an acute angle with respect to said longitudinal axis thereby directing the beam of light emitted by said bulb in different directions;

said bulb being disposed in a fixed angular relationship with respect to said longitudinal axis of said casing as said swivel head is rotated about said swivel axis; and a pocket in said swivel head for holding a spare bulb.

* * * * *